US008894745B2

(12) United States Patent
Dunn

(10) Patent No.: US 8,894,745 B2
(45) Date of Patent: Nov. 25, 2014

(54) VANE ELECTROSTATIC PRECIPITATOR

(76) Inventor: John P. Dunn, Horseheads, NY (US)

( * ) Notice: Subject to any disclaimer, the term of this patent is extended or adjusted under 35 U.S.C. 154(b) by 294 days.

(21) Appl. No.: 13/369,823

(22) Filed: Feb. 9, 2012

(65) Prior Publication Data

US 2013/0036906 A1 Feb. 14, 2013

Related U.S. Application Data

(60) Provisional application No. 61/521,897, filed on Aug. 10, 2011.

(51) Int. Cl.

| | |
|---|---|
| ***B03C 3/155*** | (2006.01) |
| ***B03C 3/12*** | (2006.01) |
| ***B03C 3/36*** | (2006.01) |
| ***B03C 3/41*** | (2006.01) |
| ***B03C 3/47*** | (2006.01) |

(52) U.S. Cl.

CPC . *B03C 3/12* (2013.01); *B03C 3/366* (2013.01); *B03C 3/41* (2013.01); *B03C 3/47* (2013.01); *B03C 2201/10* (2013.01)

USPC ..... 95/70; 95/79; 95/77; 96/55; 96/94; 96/61; 96/95

(58) Field of Classification Search

CPC ..... B03C 3/366; B03C 3/47

USPC ..... 95/57, 59, 58, 61, 62, 63, 69, 70, 78, 95/79–81; 96/15, 17, 54, 55–58, 74, 96/75–79, 95–97, 98–100, 70, 60, 65, 64, 96/66, 67, 68, 69

See application file for complete search history.

(56) References Cited

U.S. PATENT DOCUMENTS

| | | | |
|---|---|---|---|
| 1,956,591 | A | 5/1934 | Gies |
| 3,271,932 | A | 9/1966 | Newell |
| 3,338,035 | A | 8/1967 | Dinkelacker |
| 3,478,494 | A | 11/1969 | Lustenader |
| 3,678,653 | A | 7/1972 | Buschman |
| 3,733,785 | A | 5/1973 | Gallaer |
| 3,757,498 | A | 9/1973 | Hurlbut, Sr. et al. |
| 3,807,140 | A | 4/1974 | Gurvits et al. |

(Continued)

FOREIGN PATENT DOCUMENTS

| | | |
|---|---|---|
| EP | 0237512 A1 | 9/1987 |
| EP | 1131162 B1 | 2/2006 |

OTHER PUBLICATIONS

Turner et al., "Sizing and Costing of Electrostatic precipitators, Part 1", Journal of Waste Manage Association, vol. 38, pp. 458-471, 1988.

*Primary Examiner* — Duane Smith
*Assistant Examiner* — Sonji Turner
(74) *Attorney, Agent, or Firm* — Brown & Michaels, PC

(57) ABSTRACT

A vane electrostatic precipitator (VEP) controls the air flow so that the entrained air particles are continuously subjected to a stress in the form of drag as they flow in front and behind vanes electrodes in the precipitator. It is not based on achieving laminar air flow over the collecting plates. Instead, efficient collection is achieved by operating with a narrow air stream and using vane electrodes in various configurations with porous back plates that gradually reduce the flow rate of the entrained air thereby allowing the particles to precipitate and collect on the vanes.

29 Claims, 8 Drawing Sheets

(56) References Cited

U.S. PATENT DOCUMENTS

| | | | | | |
|---|---|---|---|---|---|
| 4,007,023 | A | | 2/1977 | Batza | |
| 4,172,028 | A | | 10/1979 | Dunn | |
| 4,178,156 | A | | 12/1979 | Tashiro | |
| 4,181,509 | A | | 1/1980 | Honacker et al. | |
| 4,231,766 | A | | 11/1980 | Spurgin | |
| 4,246,010 | A | | 1/1981 | Honacker | |
| 4,264,343 | A | * | 4/1981 | Natarajan et al. | 96/48 |
| 4,265,641 | A | * | 5/1981 | Natarajan | 95/79 |
| 4,412,850 | A | | 11/1983 | Kurata et al. | |
| 4,478,614 | A | | 10/1984 | Jonelis | |
| 4,481,017 | A | | 11/1984 | Furlong | |
| 4,666,475 | A | | 5/1987 | Gustavvson | |
| 4,713,092 | A | * | 12/1987 | Kikuchi et al. | 96/70 |
| 4,725,289 | A | | 2/1988 | Quintilian | |
| 4,832,710 | A | | 5/1989 | Jury | |
| 5,156,658 | A | | 10/1992 | Riehl | |
| 5,215,558 | A | | 6/1993 | Moon | |
| 5,466,279 | A | | 11/1995 | Hattori et al. | |
| 5,547,493 | A | | 8/1996 | Krigmont | |
| 5,993,521 | A | * | 11/1999 | Loreth et al. | 96/69 |
| 6,004,376 | A | | 12/1999 | Frank | |
| 6,482,253 | B1 | | 11/2002 | Dunn | |
| 6,524,369 | B1 | | 2/2003 | Krigmont | |
| 6,773,489 | B2 | | 8/2004 | Dunn | |
| 6,962,620 | B2 | | 11/2005 | Chang et al. | |
| 7,105,041 | B2 | | 9/2006 | Dunn | |
| 7,582,144 | B2 | * | 9/2009 | Krigmont | 96/16 |
| 7,582,145 | B2 | * | 9/2009 | Krigmont | 96/66 |
| 7,585,352 | B2 | | 9/2009 | Dunn | |
| 2001/0039877 | A1 | | 11/2001 | Hein | |
| 2009/0071328 | A1 | * | 3/2009 | Dunn | 95/62 |

* cited by examiner

VANE ELECTROSTATIC PRECIPITATOR

REFERENCE TO RELATED APPLICATIONS

This application claims one or more inventions which were disclosed in Provisional Application No. 61/521,897, filed Aug. 10, 2011, entitled "VANE ELECTROSTATIC PRECIPITATOR (VEP)". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of electrostatic precipitators. More particularly, the invention pertains to vane electrostatic precipitators.

2. Description of Related Art

U.S. Pat. No. 4,172,028 discloses an electrostatic sieve having parallel sieve electrodes that are either vertical or inclined. The particles are normally introduced into the electric sieve under the control of a feeder that is placed directly in front of the opposing screen electrode. The powder is attracted directly from the feeder tray to the opposing screen electrode by an induced electric field that exists between the tray and the screen electrode. This system is a static air system.

U.S. Pat. No. 4,725,289 uses flow dividers in an electrostatic precipitator to try to control flow. Discharge of collected dust particles is still taking place where the air flow is relatively high, making re-entrainment a strong possibility.

Prior art precipitators have difficulty collecting highly conductive and very poorly conductive particulates.

There is also a need to improve on present electrostatic precipitator technology used to continuously collect coarse and fine coal ash particles from coal fired boilers related to the fact that bag houses are now used in conjunction with electrostatic precipitators to better clean the air.

SUMMARY OF THE INVENTION

A vane electrostatic precipitator (VEP) controls the air flow so that the entrained air particles are continuously subjected to a stress in the form of drag as they flow in front and behind vanes electrodes in the precipitator. Collection is not based on achieving laminar air flow over the collecting plates. Instead, efficient collection is achieved by operating with a narrow air stream and using vane electrodes in various configurations with porous back plates that gradually reduce the flow rate of the entrained air, thereby allowing the particles to precipitate and collect on the vanes.

DETAILED DESCRIPTION OF THE INVENTION

Figure 1:
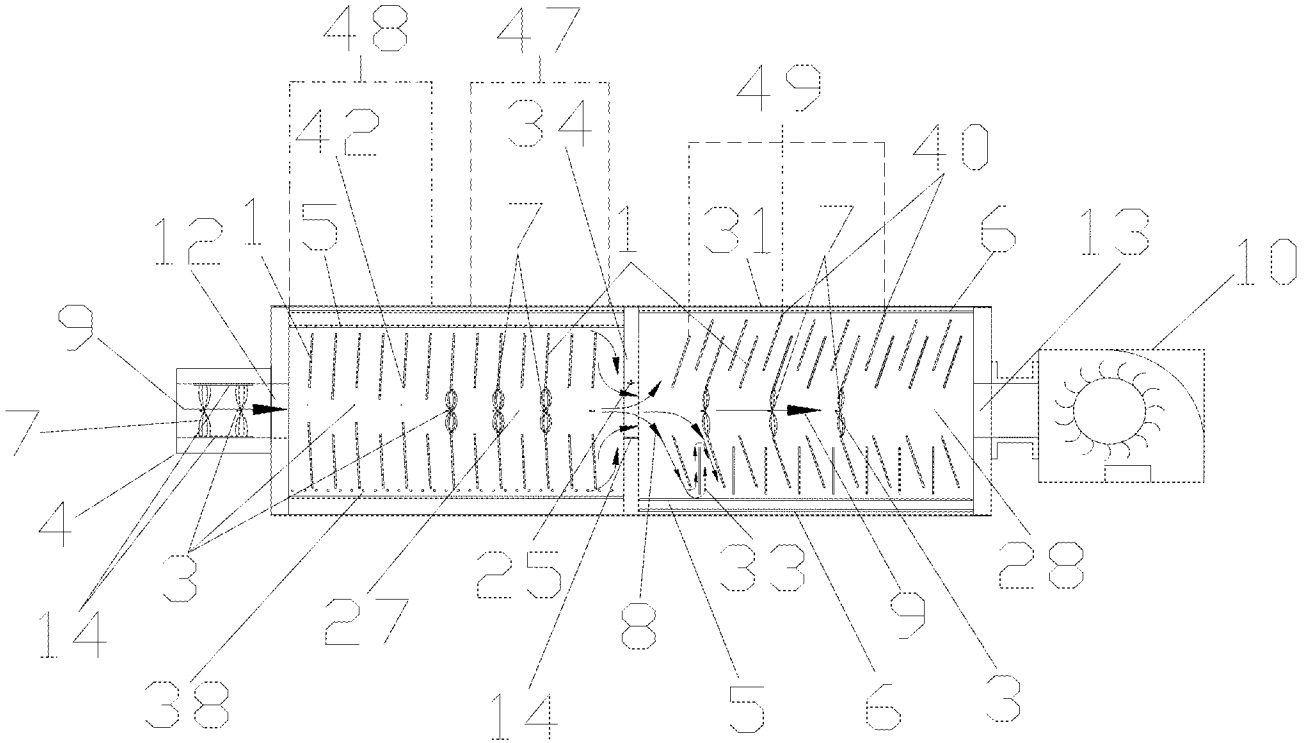
FIG. 1 shows a cross sectional view of a horizontal airflow dual chamber vane electrostatic precipitator showing several vane configurations that can be used in an embodiment of the present invention.

The need to improve on methods used to continuously collect coarse and fine aerosol and industrially generated particles using the existing electrostatic precipitators (ESP) is an ongoing effort especially in the collection of coal fired ash. The vane electrostatic precipitators (VEP) described herein improve the process of collection of fine (<2.5 microns) and coarse particles as well as substantially reducing or eliminating re-entrainment and reducing the overall size of the precipitator.

The vane electrostatic precipitators disclosed herein remove and continuously collect coarse, fine and sub micron particles from an air stream by inducing entrained air to follow a tortuous flow path that slows the rate of flow of both the gas and the particles. The vane electrostatic precipitators are designed to induce a lateral flow that allows the particles to be collected on the vanes and other collecting devices so that when the particles are removed by impact, they fall into the dust collecting chamber without returning to the main air stream. The vane electrostatic precipitators use a single or multiple narrow air streams or channels that initially draw entrained air past external pre-chargers and then into the vane electrostatic precipitator collection chamber.

The VEP concept is not based on achieving laminar air flow over the collecting plates as desired with standard electrostatic precipitators, but controlling the air flow so that the entrained air particles are continuously subjected to a stress in the form of drag, as they flow in front and behind vanes electrodes in the precipitator. The designs herein create turbulence in the air flow to improve collection efficiency.

Efficient collection is achieved by using vane electrodes in various configurations and porous back plates that gradually reduce the flow rate of the entrained air, thereby allowing the particles to precipitate and collect on the vanes. Entrained air flows over the face and back side of vanes that not only collect the particulates but continuously induce resistance to the flow of entrained air and conversely increases the chance for particle collection.

There is an electric field between the edges of the vanes and the central discharge electrodes. The vanes are preferably located at ground potential, so that there is no electrical field between opposing surfaces, substantially reducing the problems associated with back corona. Even if the vanes collect particles during the filtration process, the collection is primarily on the sides of the vane, and does not interfere with the electric field that is between the leading edge of the vanes and the discharge electrodes. In some embodiments, the edges of the vanes may be polished to repel particles from collecting on the ends to further reduce back corona.

The design of the pre-charger in these devices is flexible; it can be designed to provide the initial charging of particles or to achieve some aggregation or agglomeration of fine and sub micron particles before they enter the vane electrostatic precipitator collection chamber. Particles entering the collection chamber continue to be charged by the discharge electrodes that are centrally located and distributed along the length of the collection chamber. Some examples of pre-chargers can be found in US Patent Publication No. 2009/0071328, published Mar. 19, 2009, entitled "GRID TYPE ELECTROSTATIC SEPARATOR/COLLECTOR AND METHOD OF USING SAME" and herein incorporated by reference. Other pre-chargers disclosed herein or known in the art could alternatively be used.

The vane electrostatic precipitators improve the process for collecting particles by taking advantage of the normal airflow pattern that occurs when air passes through the narrow aperture and expands as it enters a larger chamber. Some of the entrained air flows straight, while some expands and flows laterally over the vane electrodes as the air enters the precipitator. The vane electrodes that oppose each other are normally at some angle or near perpendicular to the air flow in order to compensate for process application and variables.

Particles that traverse over the vanes are either collected or continue on to be collected by the porous, preferably mesh-like, material or pass through the porous structure and flow back into the main air stream. The air that has passed over the vanes and through the porous material sees a gradual reduction in particle concentration and a lower velocity resulting in improved collection per unit length of precipitator.

A series of parallel vanes gradually removes a portion of the entrained air so that it circulates over the front and back of the vanes and the porous (in some preferred embodiments, mesh) material that is normally located in back of the vanes, resulting in constant re-charging of particles and gradual reduction in air velocity. In some embodiments, the vanes may be hanging from the electrostatic precipitator housing.

The type of vane, the number of vanes per linear foot, the distance between vanes, and the position or angle along the length of the vane electrostatic precipitator are designed to slow and collect particulates as well as to circulate all of the entrained air that enters to be collected. In one preferred embodiment, the distance between the vanes is between approximately ⅜" and ½". In another preferred embodiment, a distance between the vanes is larger at the input aperture and smaller at the exit aperture. In yet another preferred embodiment, a distance between the vanes is uniform throughout the precipitator. The overall dimensions, length, width and thickness of the vanes depend on the application and operational requirements such as volumetric air flow rate (CFM), particle size and concentration. Air flow measurements between some of the vane designs have been six times lower (0.3 m/sec) than the main air flow. Behind the vanes and next to the porous membrane, the air flow measured 3 times lower (0.8 m/sec) than the main air stream (2.4 m/sec). These figures are used to illustrate the potential of the vane electrostatic precipitators to efficiently collect particulates.

Increasing the number of parallel and opposed vanes increases the surface area per linear foot, and exposes particles, as well as increasing the number of electrical flux lines. The type of material and configuration of holes in the porous membrane/material vary based on the properties of the material being collected.

Having the collecting electrodes (vanes) near 90 degrees from the main air stream, as opposed to flat plate technology, results in the ability to collect conductive particles; these would not normally attach to the collecting plate but would be re-entrained into the main air stream. With the vane electrostatic precipitators described herein, the conductive particles continue to flow further into the vane, where the air movement has been substantially reduced, and therefore fall by gravity into the collection chamber below without being re-entrained.

The devices and methods disclosed herein can be used in many systems, including, but not limited to, coal fired boilers, cement manufacturing and other areas to process industrial dust and vapors. In other embodiments, the devices and methods may be used in place of cyclone dust collectors.

The vane electrostatic precipitator technology described herein improves on the development of a "Grid Electrostatic Precipitator" (GEP). Patents related to the GEP technology include U.S. Pat. No. 6,773,489, U.S. Pat. No. 7,105,041 and U.S. Pat. No. 7,585,352, the disclosures of which are herein incorporated by reference.

The Deutsch-Anderson equation, $n=1-\exp(-AW/V)$, is useful for determining particulate collection efficiency in electrostatic precipitators, including grid and vane electrostatic precipitators. In this equation, n is the collection efficiency decimal fraction; A is the collection area in square feet of an electrostatic precipitator (ESP); V is the flow rate of the gas as it enters the ESP in cubic feet per second and W is the migration velocity of a particle under the influence of electrical field in feet per second.

The previous equation is over simplified but it is a key to developing the vane electrostatic precipitator. It refers to the migration of charged particles to a collecting surface of vanes, plates, grids, porous type material, etc. The time it takes for charged particles to migrate to the collecting surface determines the overall size of the precipitator and is affected by field strength, gas viscosity and the distance it has to travel to a collecting surface.

The narrow airflow pattern used in the vane electrostatic precipitator can be achieved by using input and exit end apertures that closely match both the size and distance between the parallel and opposing vanes.

The use of a conventional flow pattern and spacing between the discharge and plate electrodes would not work with the narrow spacing, because when the collected material is removed from the plates, most of the material would be entrained back into the main air stream.

The trend in the industry has been to increase the distance between the discharge and collection electrodes. These changes are related to design changes to increase the physical strength for both the collecting plate and discharge electrodes. In contrast, the devices and methods disclosed herein reduce this distance.

With the vane electrostatic precipitator, the electrical field and the flux lines are established between the edge of the opposing vanes and the discharge electrode, allowing charged particles to move laterally out of the main air stream and flow over vane electrodes to be collected.

With the vane electrostatic precipitator, the charged particles follow the flat or contour vane electrodes into other vanes or devices that slow the airflow and collect the particles. Particles that are collected are discharged by impact and fall by gravity into a dust collection container.

Factors to be considered when designing a vane include, but are not limited to, the contour or arc of the vane, whether the vane is fixed or can rotate, the length and width of the vane, and the type of surface used on the vanes. Some textures or surfaces that can be used on the vanes include, but are not limited to, polished, oxidized or coated surfaces including, but not limited to, chrome plated or polytetrafluoroethylene (PFTE, e.g.—Teflon® surfaces) coated surfaces. Some ways to vary the texture of the vanes include, but are not limited to, grit blasting using various materials that have varying degrees of hardness. These factors vary and will depend on what is being collected, air velocity and the difficulty in removing material collected on the vanes.

These factors and others influence the amount of drag induced on both the air and particles resulting in improving the collection of charged particles. Based on how the vanes are positioned in relation to the main air flow, the collected particles that are discharged from either the vane or the collection device located after the vane either fall by gravity into the dust collection chamber or choose to circle back over the backside of the vanes towards the main air stream to be reprocessed by the next group of vanes.

In the preferred embodiments, the precipitator includes both conductive and non-conductive vanes. In one preferred embodiment, the conductive vanes are made of steel. In other preferred embodiments, the nonconductive vanes are made of fiberglass or polyester. In embodiments where one or more of the vanes is closer to the back plate than the other vanes, the closer vane is preferably made of a nonconductive material. Other conductive or nonconductive materials, as known by those skilled in the art, could alternatively be used.

The vane electrostatic precipitators described herein collect coarse and fine particles more efficiently than any prior art device device; they collect welding fumes very efficiently indicating that they collect in the 0.01 to 1.0 micron range. Fly-ash fines can be collected on the vane surfaces and removed by impact.

FIG. 1 is a cross sectional view of a two chamber horizontal airflow vane electrostatic precipitator comprising several types of opposing vane electrode (1) structures (47), (48), (49) in combination with narrow orifices (12) and (13) at both ends of the precipitator. Vane configuration (47) shows opposing vanes that are evenly spaced from each other. The overall dimensions, length, width and thickness of the vanes depend on the application and operational requirements such as flow rate (CFM), particle size and concentration.

Vane configuration (48) shows vanes with different widths and offset from the center line of the main air stream (9). Vane configuration (49) shows a modular structure. Each modular unit includes six vanes where the vanes are of the same length except for the sixth vane (40) of the modular unit (49), which is longer in width than the other vanes (1). How close these vanes (40) are to the plate (6) is determined by the air flow operating condition. The vane (40) is closer to the plate (6) at higher flow rates. The modular vane design (49) directs the air that is flowing in back of the vanes to flow back towards the main air stream (9). While two modular units, each having six vanes, are shown in the vane configuration (49) shown in FIG. 1, different numbers of vanes and different numbers of modular units could be used (for example, see FIG. 8).

The first (27) and second (28) chamber have centrally located discharge electrodes (3) that charge the particulates and establish flux lines to the vanes for charged particles to follow. Although vane configurations (47) and (48) are shown in the first chamber (27) and vane configuration (49) is shown in the second chamber (28) in the figure, any of these vane configurations (47), (48), or (49), or combinations thereof, could be included in either of these chambers (27) and (28). What determines the selection of vane configuration, the number of fields and other configurations are the material properties and operating requirements.

FIG. 1 also includes a pre-charger (4) that preferably has discharge electrodes (3) and an attracting plate (14), and one or more re-chargers (25) or field dividers (34) that also have an attracting plate electrode (14) and at least one discharge electrode (3). The field divider (34) may have an orifice the same size as the input (12) and exit (13) orifice. The field divider (34) prevents the air from flowing directly to the next field. In effect, it makes the air go back into the previous field to be cleaned again.

In the second chamber (28) of FIG. 1, the arrangements of the vanes are designed to add more drag on the air flow and improve on collection. Perforated plates, porous, preferably mesh, material (5) or vertical wire grids (or rods) (38) are located behind the vanes in the first and second chambers (27) and (28). The porous material (5) or wire grids (38) collect particles, while at the same time adding additional drag to the air flow by allowing the air to pass through the mesh and impact either another plate or the enclosure wall (31) or impact with returning particles. Advantages of this vane design are that the charged particles immediately start to be withdrawn as soon as they pass through the input orifice (12) and meet the strong electric field (7) found at the edge (42) of each opposing vane. FIG. 1 also shows that the angle of the vanes (1) in reference to the center line can be varied to improve the collection.

Figure 2:
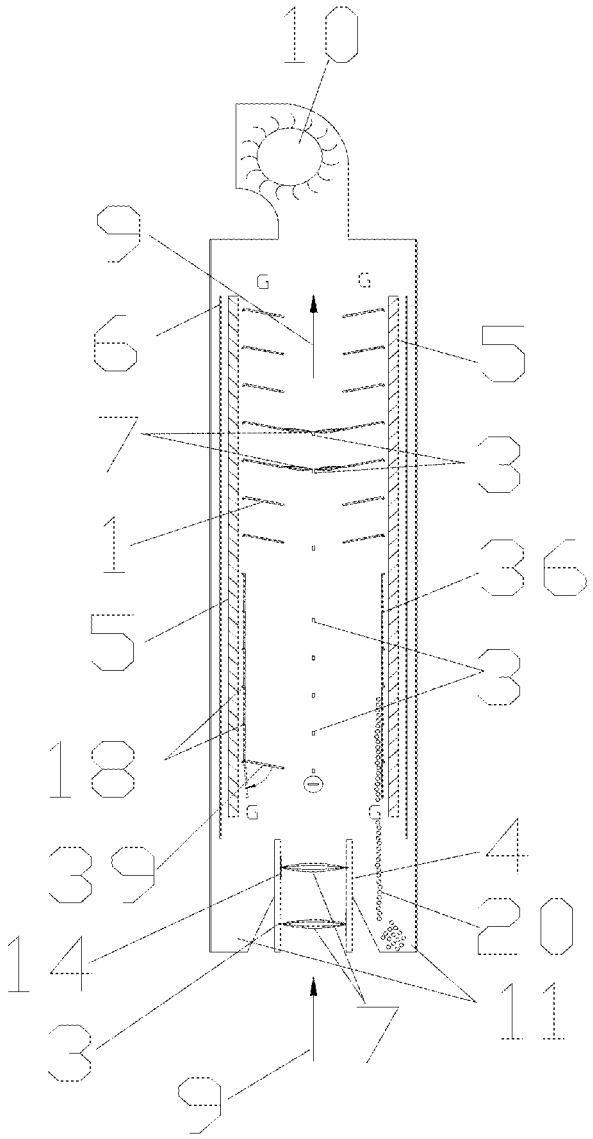
FIG. 2 shows a cross sectional view of vertical airflow through a precipitator and a vane design where the vanes are rotated for cleaning.

FIG. 2 is a cross sectional view of a vane electrostatic precipitator where the entrained air flows vertically. The main entrained air (9) is first drawn through the vane electrostatic precipitator by a blower (10) after it passes through a pre-charger (4) that has two discharge electrodes (3) and two plate electrodes (14), one on each side and offset from each other. The main air stream (9) then passes between vane electrodes (1) that are near perpendicular to the main air flow (9). Centrally located to the vanes are discharge electrodes (3) that establish an electrical field (7) between the vane electrodes (1) and the discharge electrodes (3).

Particles that are collected on the vanes (1) are removed by first rotating (39) the vanes (1) 90 degrees at the pivot point (18) into a discharge position (36) and then impacting them. Particles that are collected on mesh material (5) or the outer collection plate (6) are impacted after the vanes (1) or (2) are rotated causing these particles to fall (20) by gravity into the dust collection chamber (11) and not back into the main air stream (9). With this design, re-entry of particles should be substantially reduced or eliminated.

FIGS. 3*a* through 3*d* show cross-sectional views of the changes in the airflow when various vane designs are used in combination with various mesh or porous materials. These figures show the effect of changing the various arrangement, sizes and contour of the vanes (1). When the arc radius of a contour vane increases, the amount of stress or drag increases on both the air flow (8) and the charged particles (16), producing eddies (17) that reduce the velocity of both the lateral air flow (8) and particles (16), resulting in more efficient collection of particles. Other factors that affect the amount of drag induced on the air and particles include the width and surface characteristics of the vanes and how they are positioned and assembled relative to the air flow and air velocity.

Figure 3A:
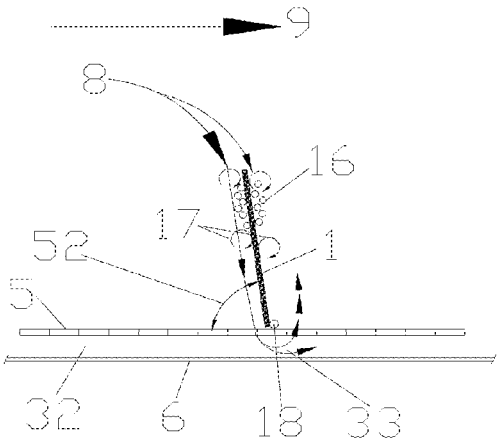
FIG. 3*a* shows a substantially vertically flat vane in an embodiment of the present invention.

FIGS. 3*a* through 3*d* show flat and contour vanes and their possible eddies (17). More specifically, FIG. 3*a* shows eddies that result on both sides of a preferably hanging, straight plate vane. The amount and type of air flow interference depends on the angle of operation (52) and air flow conditions. FIGS.

Figure 3B:
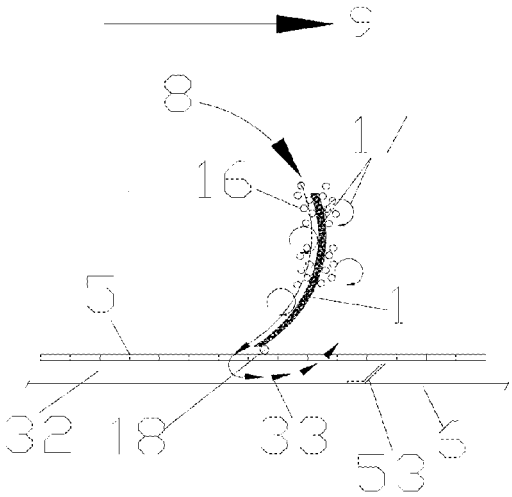
FIG. 3*b* shows a somewhat curved contour vane in an embodiment of the present invention.
Figure 3C:
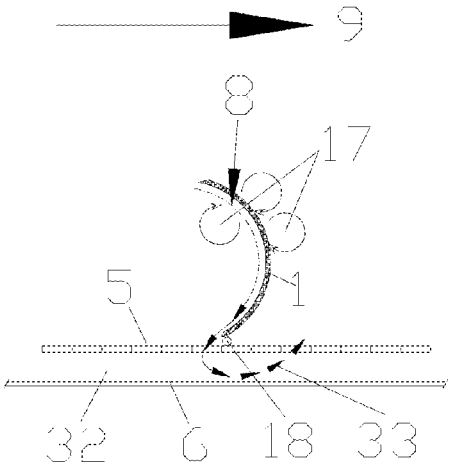
FIG. 3*c* shows a substantially curved contour vane in an embodiment of the present invention.

3*b* and 3*c* show contour vanes with different arcs or curvatures. The greater the arc, the more interference to flow while the air that flows on the back side has eddies in the upper part of the curve and more turbulent conditions as the curve approaches the pivot point (18). FIG. 3*b* also shows the use of baffles (53) between the porous material (5) and the plate (6). A baffle (53) prevents the short circuiting of the air flow between the porous material (5) and the plate (6) so that it does not circulate back towards the main air stream (9). The baffles (53) may not be required when the length of the fields are short; for long fields, a number of baffles (53) may be required. While the baffles (53) are somewhat L-shaped in the figure, any shape that could promote air flow in the air space (32) between the porous material (5) and the plate (6) could be used. The baffles (53) could be made of a solid or mesh material. Baffles (53) could be used in any of the embodiments described herein.

Figure 3D:
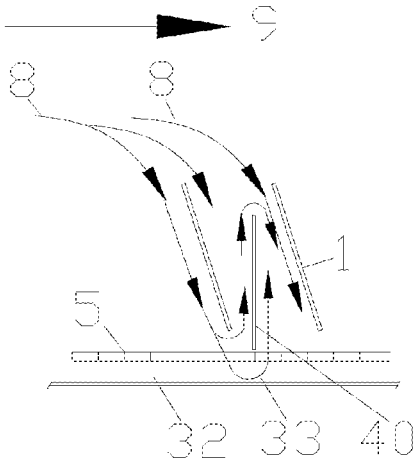
FIG. 3*d* shows a multi-vane arrangement in an embodiment of the present invention.

FIG. 3*d* shows a multi-vane arrangement, where one of the vanes (40) is closer to the porous material (5) than the other two vanes (1). The multi-vane arrangement shown in FIG. 3*d* will increase drag by causing an abrupt change in the direction of air flow. Having a short vane located between two angled vanes increases the chance of flow interference that results in improved collection.

The type of open pore structure used for the porous membrane (5) depends on the type of vanes used and the electrical arrangement. Some of the open pore materials that may be used include, but are not limited to, conductive wire or plastic mesh, or knitted metal or plastic. The porous structure selected should add resistance to flow so minimum re-entrainment takes place during the removal of particles from the vanes (1) and the mesh material (5). In some embodiments, both conductive and non-conductive ridged mesh materials are used for the mesh or porous type material. In some embodiments, materials that can be stretched and distorted to discharge particles that have been collected otherwise a standard impact or vibratory method can be used as part or all of the porous membrane (5).

Figure 4:
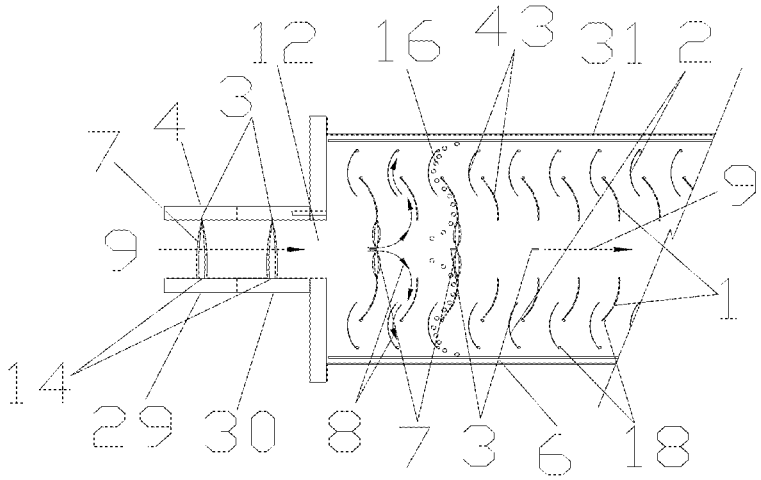
FIG. 4 shows a cross sectional top view of a vane electrostatic precipitator that uses contour dual vanes in series opposite each other in an embodiment of the present invention.

FIG. 4 is a cross sectional top view and through the center showing a vane electrostatic precipitator with opposing vane pairs on both sides of the precipitator. Similar to the other embodiments, the vanes are at ground potential such that there is no electric field between opposing vane surfaces. The opposed dual vanes (43) are in series. An electric field (7) forms between the leading edge of the interior vanes of each pair and the discharge electrodes (3) centrally located between the vanes. The dual vane (43) preferably includes a conductive vane (1) and a second vane (2), which may be conductive or non-conductive. A non-conductive vane is used in position (2) if the back plate (6) is conductive and close enough to create electrical problems. An advantage of this design is that the charged particles (16) that are flowing laterally (8) over the conductive vanes (1) will be subjected to reverse flow as they flow over the second vanes (2), adding additional drag on the particles and improving collection. The plate (6) located behind the vanes can be a solid or a porous structure that can add additional drag to the air and particle movement. External to the vane electrostatic precipitator enclosure (31) is a pre-charger (4) that is designed to have one or more pre-charging units (29) and (30), each including one or more discharge electrodes (3) and plate electrodes (14). By having multiple pre-charging units (29) and (30), adjustment can be made for variations in particle concentration or when aggregation or agglomeration of fine particles is required. When agglomeration is required, each pre-charging unit may have alternating polarity. FIGS. 1, 2 and 4 show various types of pre-chargers.

Figure 5:
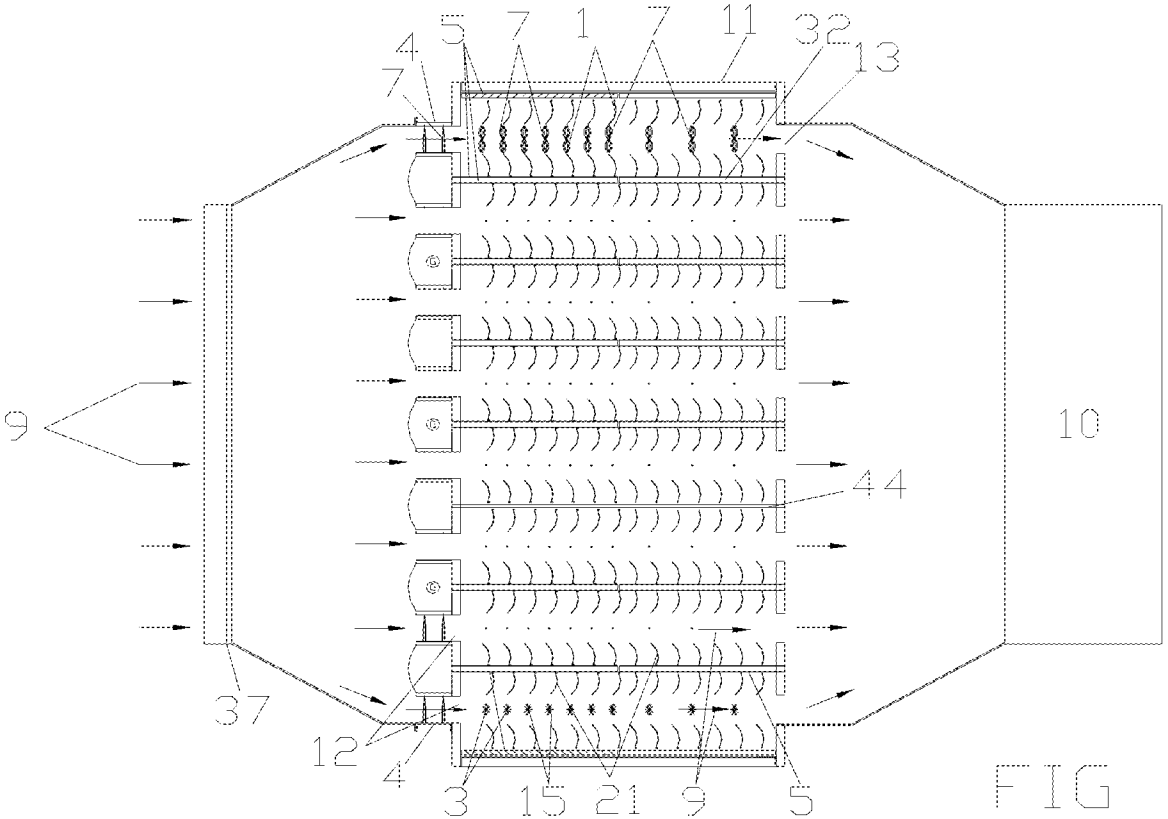
FIG. 5 shows a cross sectional center top view showing an embodiment with a multi orifice design used to increase the capacity of the vane electrostatic precipitator.

FIG. 5 is cross sectional top view showing a single field of multiple vane electrostatic precipitator chambers used to increase the capacity of a vane electrostatic precipitator. The main air flow (9) is first drawn through a porous coarse filter plate (37) and then through multiple independent input orifices (12) and exit orifices (13) by the blower (10). The physical arrangement of the centrally located contour vane electrodes (21) may use one or more designs in order to improve collection. One design shown separates the contour vanes (21) with two parallel opposing porous materials (5) that allow either collection on its surface or the air and particles to pass through and create flow interference. Another design uses a solid dividing plate (44) that would separate the chambers.

The amount of charging of the particulates (15) is dependent on the number and type of discharge electrodes (3) used, and the electrical system used. The greater the number of electrical field flux lines (7), the greater the collection.

Figure 6:
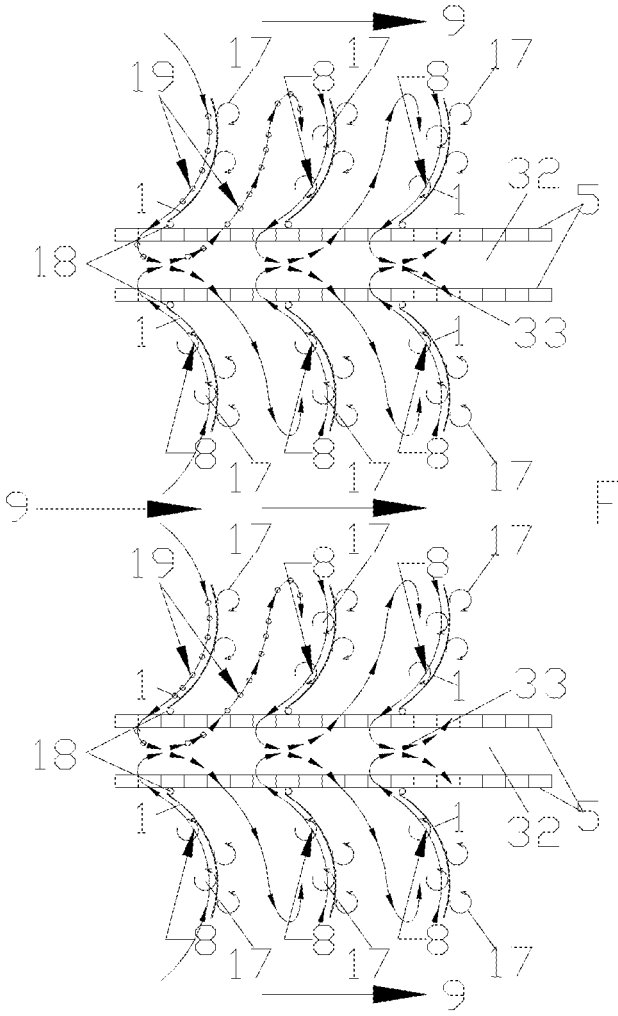
FIG. 6 shows a cross sectional view of the effect of changes on airflow in a multi-orifice vane electrostatic precipitator when a combination of a parallel and opposing mesh or grid type material are used directly behind the vanes. Also shown is an air space that can be used between the mesh materials.

FIG. 6 is an enlarged cross sectional top view of one of the electrode arrangements shown in FIG. 5. FIGS. 5 and 6 illustrate the relationship of the main air flow (9) to the contour vanes (1), the porous material (5), and the resulting lateral particle (19) and air flow (8) resulting in eddies (17) on both sides of the vanes (1). The vanes (1) are adjustable at the pivot point (18) for variations in the collection process. The air space (32) between the porous materials may be replaced with a single porous unit or a solid dividing plate (44) (FIG. 5) if required by the collection process. The air space (32) may also optionally include baffles (53) (see FIGS. 3*b* and 7).

Figure 7:
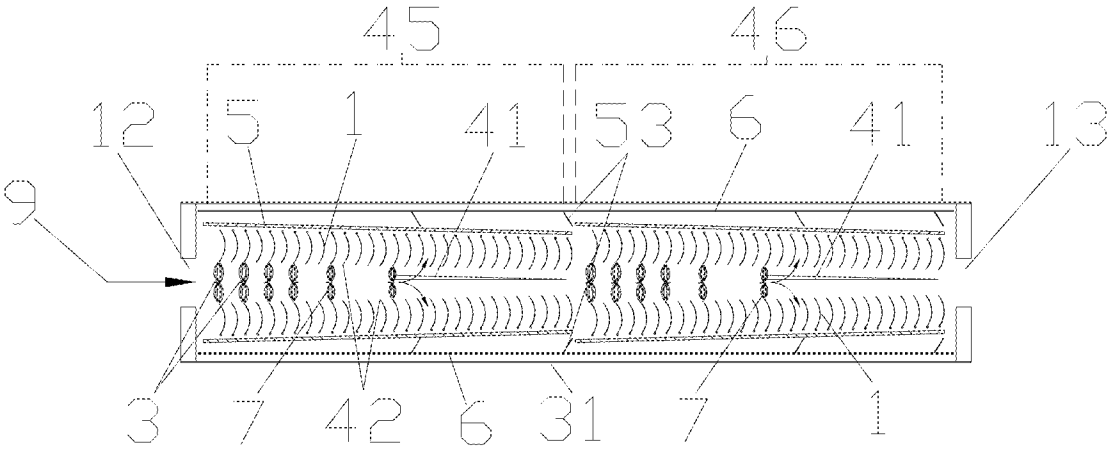
FIG. 7 shows a cross sectional view of an embodiment where the vanes opposing each other are tapered a few degrees or more towards the center with a narrow opening facing the exit end. Discharge electrodes are also shown centrally located and distributed along the length of the chamber.

FIG. 7 shows a cross sectional view of two fields (45) and (46) that have vane electrode arrangements that are tapered (41) inward towards the exit end (13). Centrally located discharge electrodes (3) are separately controlled electrically to compensate for changes in the distance between the discharge (3) and vane electrode (1). Baffles (53) behind the porous material (5) aid in circulation of the entrained air towards the main air flow (9). An advantage of this design is the gradual removal of entrained air from the main air stream (9). The combination of this vane arrangement and the corona wind generated by the discharged electrodes (3) improves the chance for good circulation of the entrained air over the vanes. The taper (41) makes it more difficult for the air to pass through the electrostatic precipitator without getting cleaned. Embodiments with a taper (41) may eliminate the end for multiple fields and/or a field divider. In this preferred embodiment, the taper will vary based on the length of the field (45), (46).

All of the various vane configurations shown in FIGS. 1 and 7 works well for the collection of fly-ash from coal burning boilers. FIG. 7 also shows the use of baffles or vanes that are use to redirect the flow of entrained air back towards the main air flow.

Figure 8:
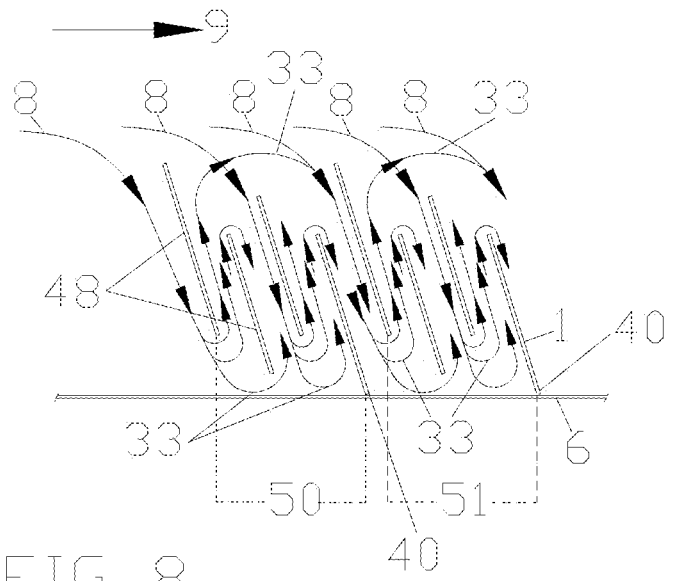
FIG. 8 shows the expected air flow for an embodiment with a four vane modular unit.

FIG. 8 shows the expected air flow (8) and (33) for two four-vane (1) modular units (50) and (51) that have vanes offset from each other and away from the main air flow (9) and towards the back plate (6). The last vane (40) in each modular unit (50) and (51) is very close to the plate (6). This combination of vane offsets (48) and modular units assures circulation of the entrained air (33) as well as improving the assembly of the vanes in the field; it should be noted that the size and the number of vanes (1), (40) in a modular unit (50) and (51) depend on application requirements. In some embodiments, the vane (40) is made of a dielectric or another nonconductive material. In some embodiments, the vane (40) is made of aluminum or plastic.

Figure 9:
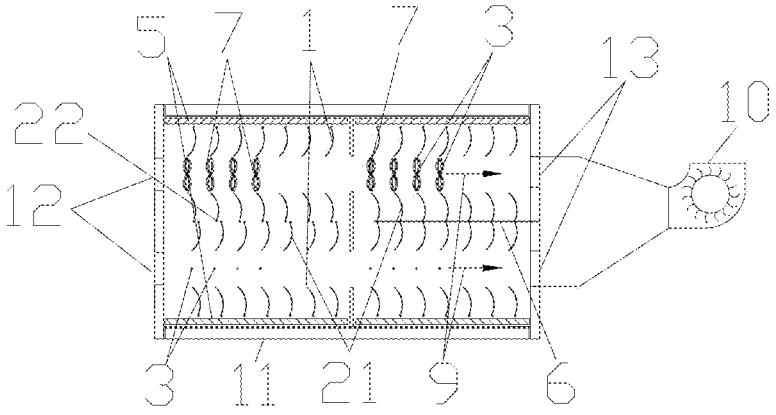
FIG. 9 is a cross sectional view of a vane electrostatic precipitator in an embodiment of the present invention.

FIG. 9 is a cross sectional top view showing a dual chamber design used to increase the capacity of a vane electrostatic precipitator. The main air flow (9) is drawn through multiple input orifices (12) and exit orifices (13) by a blower (10). The physical arrangement of the centrally located contour vane electrodes (21) may use one or more designs in order to improve collection. One design overlaps (22) each vane (21) so that the air flow from each side intersects and on the back side of the opposite side, vanes create particle impact that reduces or eliminates particle flow. Another design separates the contour vanes (21) with a solid plate (6) or a porous material (5) that allows either collection on its surface or the air and particles to pass through the mesh and create flow interference. Either vane design could be used in either section of the electrostatic precipitator.

The devices and methods disclosed herein result in near zero particle re-entrainment. They also permit the collection of a full range of particle sizes and the collection of both conductive and high resistivity particles. The devices and methods also operate at higher air velocities, resulting in the equipment being smaller in size.

The embodiments described herein significantly increase the collection efficiency of electrostatic precipitators. The VEPs increase the collection surface area per unit length by a factor of two or more over prior art electrostatic precipitators. Also, by having the vanes at ground potential, there is no electrical field between opposing surfaces, substantially reducing the problems associated with back corona. Repeated circulation of entrained air induces enough drag on both the air and particle flow that charged particles attach to both sides of the vane surfaces. Repeated circulation of the air and particles over the vanes is more efficient than using a flat plate laminar air flow system for the collection of particulates. The embodiments have a broad design base that is able to meet different process and material requirements.

Some applications for the VEPs include, but are not limited to, collecting fly-ash particles from coal fired boilers, collecting hazardous waste, collecting glass and ceramic dust particles, collecting welding fumes (which can be between 0.01 micron and 1 micron), collecting metal dust particles, collecting and returning solid particles to a process, and the cyclone market.

An advantage of the VEPs described herein is the ability to collect particles in the lower particle size range (<2.5 microns) and reduce the dependence on bag filters. These particles may include elemental and compounds of mercury. The VEPs also realize energy savings related to elimination of filter bags. There is also a major reduction or elimination of particle re-entrainment. The VEPs are able to collect both conductive and non-conductive particles. The VEPs have a smaller equipment footprint, which leads to energy savings. The VEPs also eliminate back corona problems and can operate at a higher gas velocity than prior art electrostatic precipitators.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for removing particles from a single narrow air stream, comprising the step of passing the narrow air stream over a plurality of opposing rotatable vane type collecting electrodes each having a leading edge and a plurality of discharge electrodes centrally located between the leading edges of the vane type collecting electrodes in a vane electrostatic precipitator, wherein the plurality of vane type collecting electrodes are located at ground potential such that there is an electrical field established between a leading edge of the vane type collecting electrodes and the discharge electrodes and no electrical field between opposing vane surfaces.

2. The method of claim 1, further comprising the step of creating the narrow air stream using a narrow input orifice and a narrow output orifice.

3. A method of collecting a plurality of particulates, comprising the step of collecting the particulates using a vane electrostatic precipitator comprising a combination of rotatable vane type electrodes located at ground potential and each having a leading edge, and a plurality of discharge electrodes centrally located between the leading edges of the vane electrodes such that there is an electrical field established between a leading edge of the vane electrodes and the discharge electrodes and no electrical field between opposing vane surfaces.

4. The method of claim 3, wherein the vane electrodes comprise a plurality or an array of opposing straight, contour or arc type vane electrodes in the vane electrostatic precipitator.

5. The method of claim 3, wherein the vane electrostatic precipitator further comprises a mesh or porous type material located behind the vane electrodes.

6. The method of claim 5, wherein the mesh or porous type material is used adjacent and directly behind the vane electrodes and serves to collect particulates and add flow resistance to particles that are not collected.

7. The method of claim 5, wherein the vane electrostatic precipitator further comprises a solid plate, wherein an air space is located between the mesh or porous type material and the solid plate.

8. The method of claim 7, wherein the vane electrostatic precipitator further comprises at least one baffle between the porous material and the solid plate.

9. The method of claim 3, further comprising the step of externally pre-charging the particulates with at least one pre-charger.

10. The method of claim 3, further comprising the step of adjusting an operating angle of the vane electrodes in reference to a center line of air flow.

11. The method of claim 3, further comprising the step of tapering rows of the plurality of opposing vanes with a converging angle along a length of the major axes starting from an input aperture towards an exit aperture of the vane electrostatic precipitator.

12. The method of claim 3, further comprising the step of varying a distance between the vanes of the vane electrostatic precipitator such that the distance is larger at an input aperture of the vane electrostatic precipitator and smaller at an exit aperture of the vane electrostatic precipitator.

13. The method of claim 3, further comprising the step of varying a contour or an arc of at least one vane electrode in the electrostatic precipitator.

14. The method of claim 3, further comprising the step of rotating at least one vane out of a main air stream and then impacting the vane to discharge a plurality of collected particles.

15. The method of claim 3, wherein the vane electrodes comprise a plurality of dual vane pairs in series, wherein each dual vane pair comprises a first vane electrode and a second vane electrode and wherein the first vane electrode in the dual vane pair faces an opposite direction than the second vane electrode in the dual vane pair.

16. An electrostatic precipitator comprising a plurality of rotatable vanes located at ground potential and each having a leading edge, and a plurality of discharge electrodes centrally located between the leading edges of the vanes, wherein there is an electrical field established between a leading edge of the vanes and the discharge electrodes and no electrical field between opposing vane surfaces.

17. The electrostatic precipitator of claim 16, further comprising a mesh or porous type material located behind the vanes.

18. The electrostatic precipitator of claim 17, wherein both conductive and non-conductive ridged mesh materials are used for the mesh or porous type material.

19. The electrostatic precipitator of claim 17, wherein the mesh or porous type material is used adjacent and directly behind the vane electrodes and serves to collect particulates and add flow resistance to particles that are not collected.

20. The electrostatic precipitator of claim 17, wherein the electrostatic precipitator further comprises a solid plate, wherein an air space is located between the mesh or porous type material and the solid plate.

21. The electrostatic precipitator of claim 20, wherein the electrostatic precipitator further comprises at least one baffle between the porous material and the solid plate.

22. The electrostatic precipitator of claim 16, wherein at least two vanes comprise a modular unit, wherein one of the vanes in the modular unit is located closer to the mesh or porous type material than the other vanes in the modular unit.

23. The electrostatic precipitator of claim 16, further comprising a plurality of coatings and textures on the vanes.

24. The electrostatic precipitator of claim 16, wherein multiple fields are used parallel to each other and in series.

25. The electrostatic precipitator of claim 16, wherein multiple fields are separated from each other by a parallel porous material that is in close proximity to the ends of the vanes.

26. The electrostatic precipitator of claim 16, wherein multiple fields are separated from each other by a parallel porous material that has air separating the parallel porous material.

27. The electrostatic precipitator of claim 16, wherein the plurality of vanes comprise a plurality of conductive vanes and a plurality of non-conductive vanes.

28. The electrostatic precipitator of claim 16, wherein the vane electrodes comprise a plurality or an array of opposing straight, contour or arc type vane electrodes in the electrostatic precipitator.

29. The electrostatic precipitator of claim 16, wherein rows of the plurality of opposing vanes are tapered with a converging angle along a length of the major axes starting from an input aperture towards an exit aperture of the electrostatic precipitator.

* * * * *